US010653256B2

(12) United States Patent
Hong

(10) Patent No.: US 10,653,256 B2
(45) Date of Patent: May 19, 2020

(54) LID

(71) Applicant: Kibeom Hong, Bloomington, IN (US)

(72) Inventor: Kibeom Hong, Bloomington, IN (US)

( * ) Notice: Subject to any disclaimer, the term of this patent is extended or adjusted under 35 U.S.C. 154(b) by 0 days.

(21) Appl. No.: 15/147,100

(22) Filed: May 5, 2016

(65) Prior Publication Data

US 2016/0325890 A1 Nov. 10, 2016

Related U.S. Application Data

(60) Provisional application No. 62/157,268, filed on May 5, 2015, provisional application No. 62/172,426, filed on Jun. 8, 2015.

(51) Int. Cl.

| | |
|---|---|
| ***A47G 19/22*** | (2006.01) |
| ***B65D 47/26*** | (2006.01) |
| ***B65D 43/02*** | (2006.01) |

(52) U.S. Cl.

CPC ..... *A47G 19/2272* (2013.01); *B65D 43/0212* (2013.01); *B65D 47/265* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01)

(58) Field of Classification Search

CPC ..... A47G 19/2272; B65D 2543/00046; B65D 47/265

See application file for complete search history.

(56) References Cited

U.S. PATENT DOCUMENTS

| | | | | |
|---|---|---|---|---|
| 9,327,881 | B1 * | 5/2016 | Saranga | B65D 43/0204 |
| 2003/0089713 | A1 * | 5/2003 | Belt | B65D 47/265 220/253 |

* cited by examiner

*Primary Examiner* — Shawn M Braden
(74) *Attorney, Agent, or Firm* — C. John Brannon; Brannon Sowers & Cracraft PC

(57) ABSTRACT

A disposable coffee cup lid including a generally circular panel member, an endless sidewall member having an inner face, an oppositely disposed outer face, and a generally circular top panel extending between the inner and outer faces, wherein the endless sidewall member extends generally perpendicularly from the generally circular panel member, a circular cup-engaging flange portion operationally connected to the endless sidewall member, an aperture formed in the endless sidewall member, and a slide member operationally connected to the endless sidewall member for selectively covering the aperture.

1 Claim, 4 Drawing Sheets

LID

CROSS-REFERENCE TO RELATED APPLICATIONS

This patent application claims priority to U.S. Provisional Patent Application Ser. Nos. 62/157,268, filed on May 5, 2015, and 62/172,426, filed on Jun. 8, 2015.

TECHNICAL FIELD

The present invention relates generally to hot lid for cups. More particularly, the invention relates to a disposable hot lid that is efficient in preventing the spillage and insulating the heat of the liquid content inside the cup.

BACKGROUND

A hot lid is a removable device that engages a cup to cover and seal the mouth of the cup while providing additional features. These features may include thermal insulation, enhanced prevention of spillage, and decoration. A conventional disposable hot lid may be one of two different types, either an open or a re-closable lid. The open hot lid is the simplest and is cheaper to produce; however, the presence of an open sip hole makes it more prone to spillage and less thermally insulating. Supplemental devices have been provided to address these issues, such as plugs or "splash sticks", which are essentially plastic plugs for sip holes from which a stir stick extends into the drink. However, these plug devices tend to also provide an unpleasant taste giving rise to consumer avoidance and quick disposal when once used. While the "splash stick" offers a better solution to the spillage and heat insulation problem, when disengaged from the sip hole it is difficult to keep the "splash stick" somewhere clean and hygiene, the wet portion of the stick can easily contribute to coffee stains on clothing, and it takes effort for the users to put the stick back into the sip hole to prevent the problems.

The re-closable hot lids include a plastic flap that is somewhat effective in preventing the spillage and keeping cup content warm, but the plastic flap piece fails to completely seal the cup and also tends to irritate or tickle the user's nose.

Thus, there remains a need for an improved disposable lid for use with coffee and other drink cups. The present novel technology addresses this need.

DETAILED DESCRIPTION

Figure 1:
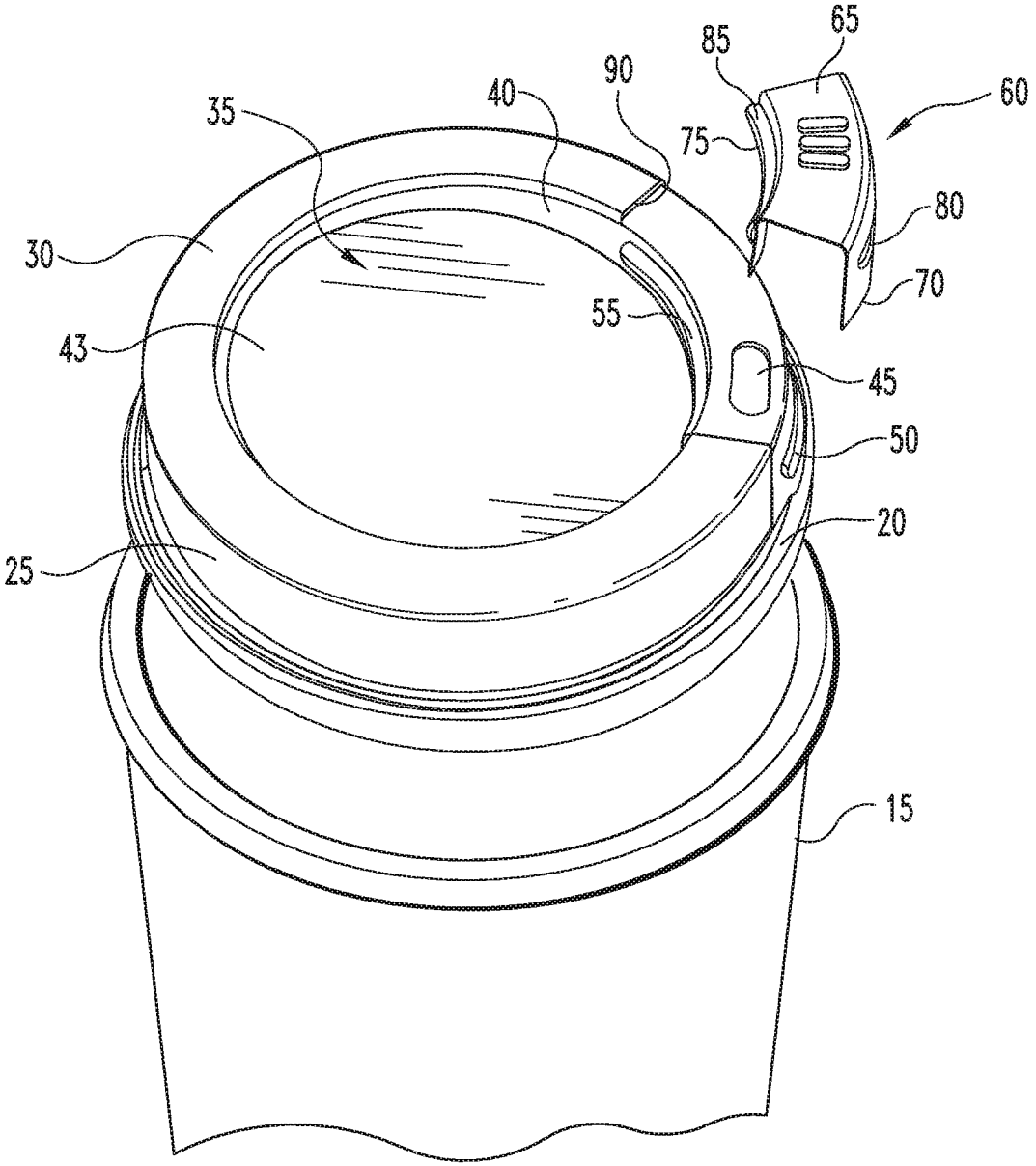
FIG. 1 is a perspective view of a first embodiment of the present novel technology, a disposable coffee cup lid system with a sliding member for selectively occluding a pour hole.
Figure 2:
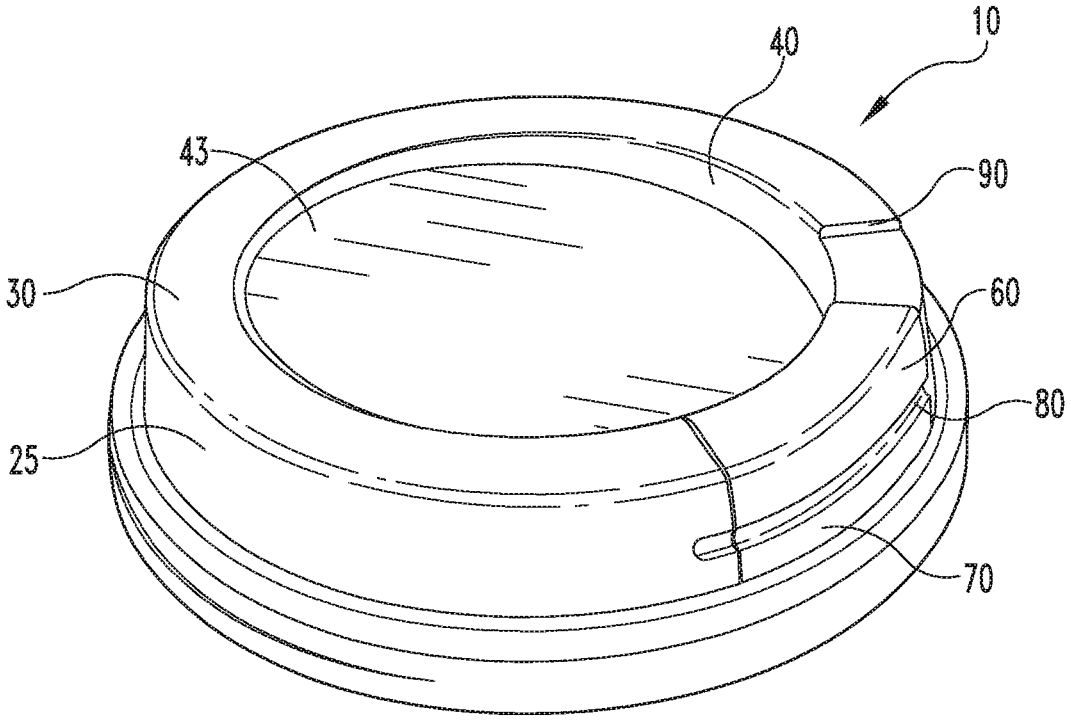
FIG. 2 is a second perspective view of the embodiment of FIG. 1 with the sliding member engaged to the lid.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates A first embodiment of the present novel technology is illustrated in FIGS. 1-2, a lid 10 for engagement with a disposable coffee or like cup 15 to provide a sealed enclosure to keep the contents of the cup 15 at temperature and to prevent spillage thereof. The lid 10 is typically intended for use with a cup in the upright position. The lid 10 includes a generally circular flange portion 20 for engaging the top of a cup 15, a generally circular endless outer sidewall portion 25 extending away from the flange portion 20, a generally circular topwall portion 30 having an outer diameter 31 and an inner diameter 33 and extending circularly inwardly from the sidewall portion 25 to define an inner circle 35, a circular inner sidewall portion 40 extending from the inner diameter 33 of the topwall 30 around and defining the inner circle 35 and oriented parallel to the outer sidewall portion 25, and a panel portion 43 connected to the inner sidewall portion 40 and completely closing the inner circle 35. A typically oval aperture 45 is formed through the topwall 30. An outer elongated ridge 50 is formed on the sidewall portion 25 and an inner elongated ridge 55 is formed on the inner sidewall portion 40. Typically, both ridges 50, 55 are positioned opposite one another. The ridges 50, 55 typically extend along the centerline of each endless wall 25, 40, and more typically the oval aperture 45 is centered relative to each ridge 50, 55. The ridges 50, 55 may be indented outwardly or inwardly relative to their respective walls 25, 40.

A slide or movable plug 60 attaches to the lid 10 for selectively occluding the aperture 45. The slide 60 includes a flat, curved panel (also referred to as a 'clip panel' and/or 'pour hole occluding member' herein) 65 for engaging the topwall 30 with a pair of oppositely disposed sidewall engaging panels 70, 75 extending therefrom. The panels 70, 75 are likewise slightly curved to match the curvature of the sidewalls 25, 40, and the clip panels 65, 70, 75 snugly engage respective cup portions 30, 25, 40 when engaged thereto. Each sidewall 70, 75 further includes a ridge-engaging portion 80, 85 formed thereinto that snugly engages a respective ridge 50, 55 when the slide 60 is engaged with the lid 10. The outer panel 70 is a billboard panel and is typically festooned with a logo or like advertising image, such as that of a coffee provider, a coffee brand, a specific drink brand, a movie, or the like.

Typically, the topwall 30 includes a ledge wall or like member 90 positioned to act as a stop to restrict further movement of the slide 60. The stop 90 is typically positioned to prevent the slide from moving past a position that occludes the oval aperture 45.

The lid 10 and slide 60 are is typically formed from a lightweight structural material, such as plastic. In the embodiment described above, the slide attaches over the lid 10, specifically snugly clipping onto the sidewalls 25, 40 and covering the topwall 30. In some embodiments, such as those illustrated in FIGS. 3-5, the slide 60 is positioned beneath the topwall 30 and is enclosed between sidewalls 25, 40. An elongated slot 100 is formed through the sidewall 25, and an engagement member 105 connected to the slide 60 is positioned on the opposite side of the slot 100 for moving the slide 60 from an open position wherein the slide

60 does not occlude the oval aperture 45 to a closed position wherein the slide 60 blocks the oval aperture 45.

Figure 3A:
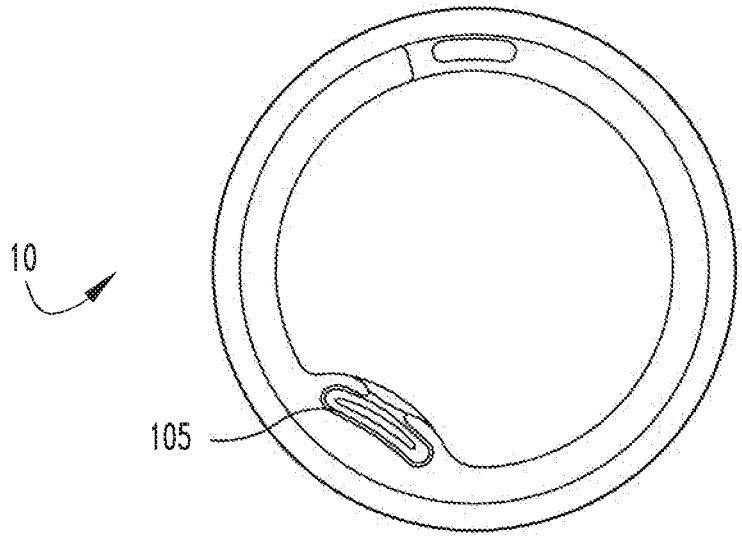
FIG. 3A is a top elevation view of a second embodiment disposable lid of the present novel technology.
Figure 3B:
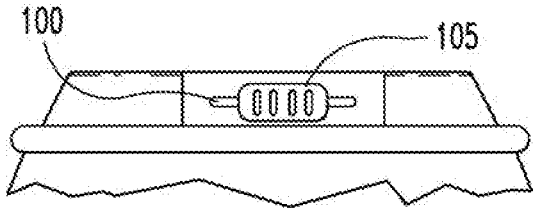
FIG. 3B is a side view of the second embodiment disposable lid of the present novel technology.
Figure 4:
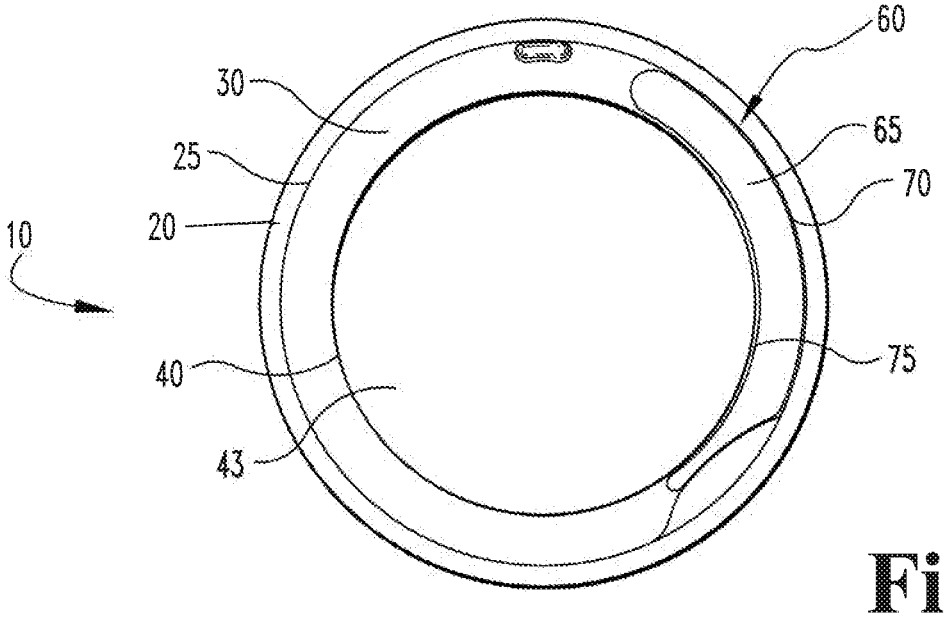
FIG. 4 is a sectional view of the lid of FIG. 3A.
Figure 5:
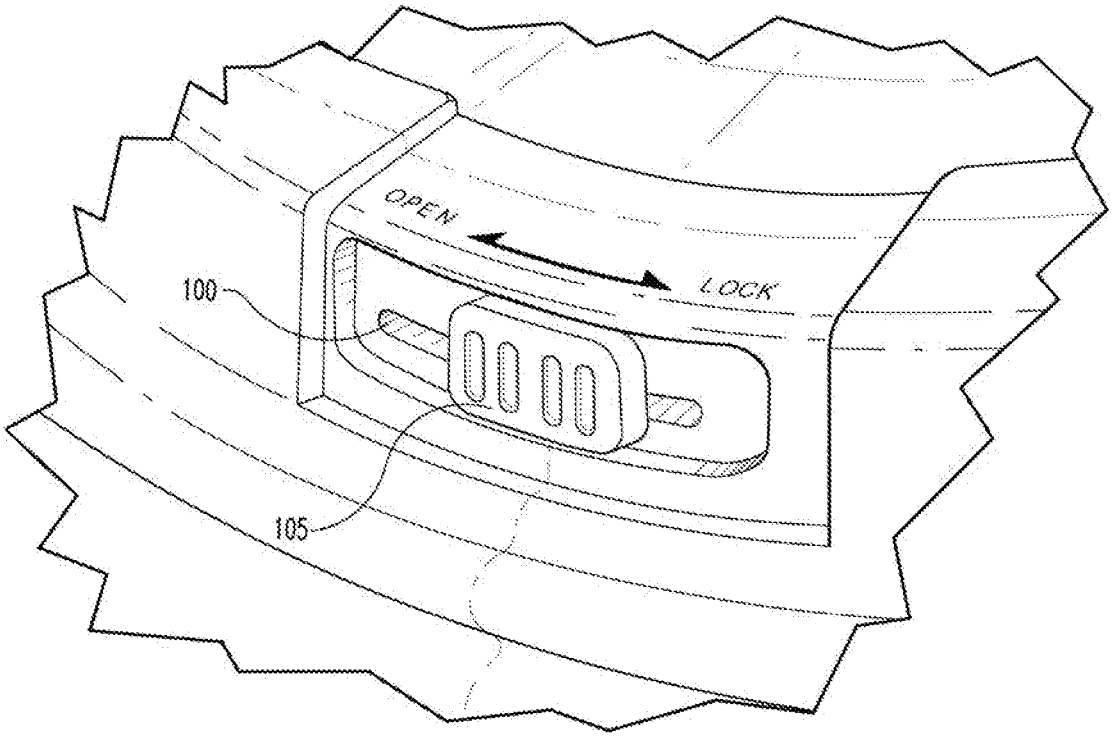
FIG. 5 is an enlarged partial perspective view of FIG. 3A.

In some variations of the embodiment shown in FIGS. 3-5, the slide includes an aperture that aligns with the oval aperture 45 to allow the passage of fluid therethrough; unless the apertures are aligned, fluid flow is blocked.

In operation, a coffee drinker after receiving an at least partially filled coffee cup, engages the disposable lid 10 having a pour hole 45 to an at least partially filled coffee cup 15. When not actively drinking, the user moves the slide 60, and in particular the pour hole occluding member 65, to a position occluding the pour hole 45 to keep liquid in the cup 15. When desiring a drink, the user moves the slide 60 to a position away from the pour hole 45 to extract liquid from the cup 15. Once finished, the cup 15 and the lid 10 are thrown into the trash While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A disposable cup lid, consisting of:

a generally circular panel member;

a circular cup-engaging flange portion connected to and extending from the generally circular panel member;

an endless sidewall member having an inner face; an oppositely disposed outer face; a first elongated ridge formed on the outer face; a second, oppositely disposed elongated ridge formed on the inner face; and a generally circular top panel extending between the inner and outer faces; wherein the endless sidewall member is connected to and extends away from the circular cup-engaging flange portion;

an aperture formed in the endless sidewall member; and a slide member operationally connected to the endless sidewall member for selectively covering the aperture;

wherein the slide member further comprises a top panel portion, an inner panel portion, an oppositely disposed outer billboard panel portion, a first mating ridge formed on the outer billboard panel portion and a second mating ridge formed on the inner panel portion; and wherein the first and second mating ridges respectively matingly engage with the respective first and second elongated ridges.

* * * * *